US008980114B2

(12) United States Patent
Ikagawa

(10) Patent No.: US 8,980,114 B2
(45) Date of Patent: Mar. 17, 2015

(54) FILM REMOVING METHOD, NOZZLE FOR REMOVING FILM, AND FILM REMOVING DEVICE

(75) Inventor: Yoshinori Ikagawa, Ibara (JP)

(73) Assignee: Tazmo Co., Ltd., Okayama (JP)

( * ) Notice: Subject to any disclaimer, the term of this patent is extended or adjusted under 35 U.S.C. 154(b) by 0 days.

(21) Appl. No.: 14/113,261

(22) PCT Filed: Apr. 11, 2012

(86) PCT No.: PCT/JP2012/059847
§ 371 (c)(1),
(2), (4) Date: Oct. 22, 2013

(87) PCT Pub. No.: WO2012/147512
PCT Pub. Date: Nov. 1, 2012

(65) Prior Publication Data

US 2014/0042124 A1 Feb. 13, 2014

(30) Foreign Application Priority Data

Apr. 26, 2011 (JP) ..... 2011-097787

(51) Int. Cl.

| | |
|---|---|
| ***C03C 15/00*** | (2006.01) |
| ***B05C 5/02*** | (2006.01) |
| *B05C 9/12* | (2006.01) |
| *B05C 11/06* | (2006.01) |

(52) U.S. Cl.
CPC ..... *B05C 5/02* (2013.01); *B05C 5/0208* (2013.01); *B05C 5/022* (2013.01); *B05C 9/12* (2013.01); *B05C 11/06* (2013.01)
USPC ..... 216/90; 216/83; 427/107; 427/122; 427/225; 427/240; 427/425; 156/345.2; 134/113

(58) Field of Classification Search
USPC ..... 216/83, 90; 427/107, 122, 225, 240, 427/425, 497; 156/345.2, 113; 134/113
See application file for complete search history.

(56) References Cited

U.S. PATENT DOCUMENTS 5,853,803 A * 12/1998 Tateyama et al. ..... 427/240
8,016,976 B2 * 9/2011 Kamei et al. ..... 156/345.55

(Continued)

FOREIGN PATENT DOCUMENTS

JP 2001-244169 A 9/2001
JP 2002-159923 A 6/2002

(Continued)

OTHER PUBLICATIONS

International Search Report for corresponding International Application No. PCT/JP2012/059847 mailed Jul. 17, 2012.

*Primary Examiner* — Duy Deo
*Assistant Examiner* — Maki Angadi
(74) *Attorney, Agent, or Firm* — Renner, Otto, Boisselle & Sklar, LLP

(57) ABSTRACT

A film in a dry state is efficiently dissolved and removed. A film removing method includes steps of moving a nozzle head (10B) close to a soluble film (201) formed on a substrate (200), forming a liquid pool (302) of chemical liquid (300) between the nozzle head (10B) and the film (201) by continuously and simultaneously discharging and sucking the chemical liquid (300) from the nozzle head (10B), and horizontally moving the substrate (100) in a state in which the nozzle head (10B) and the surface of the film (201) are not contacted so as to relatively move the liquid pool (302) of the chemical liquid on the substrate (100).

19 Claims, 15 Drawing Sheets

(56) References Cited

U.S. PATENT DOCUMENTS

| | | | | |
|---|---|---|---|---|
| 2004/0197433 | A1* | 10/2004 | Terada et al. | 425/174.4 |
| 2004/0226916 | A1* | 11/2004 | Kobayashi et al. | 216/83 |
| 2005/0067100 | A1* | 3/2005 | Kobayashi et al. | 156/345.11 |

FOREIGN PATENT DOCUMENTS

| | | | |
|---|---|---|---|
| JP | 2003-109896 | A | 4/2003 |
| JP | 2004-281258 | A | 10/2004 |
| JP | 2008-018301 | A | 1/2008 |

* cited by examiner

FIG.2A
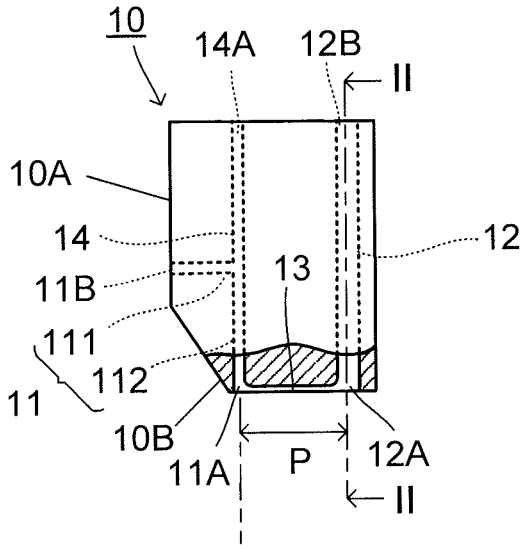
FIG.2C
II-II CROSS SECTION
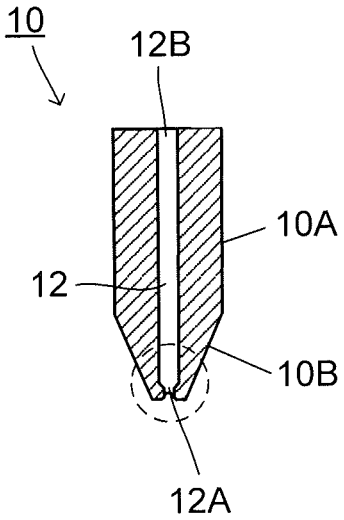
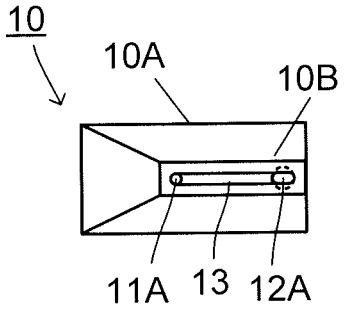
FIG.2B
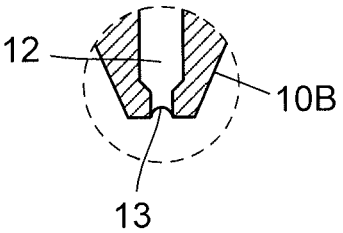
FIG.2D

FIG.7

| FLOW RATE OF SUPPLYING CHEMICAL LIQUID | 0 ~ R1<br>EXCESSIVELY LOW | R1 ~ R2<br>APPROPRIATE | R2 ~<br>EXCESSIVELY HIGH |
|---|---|---|---|
| FILM REMOVAL CHARACTERISTICS | NO LIQUID POOL FORMED, NO FILM REMOVAL PERFORMED | EFFECTIVE FILM REMOVAL BY PULSE IMPACT | WITH LIQUID POOL BLOATED, QUALITY OF FILM REMOVAL DOWNGRADED |

R1, R2: THRESHOLD VALUE OF FLOW RATE (R1 < R2)

PRIORITY ON EDGE ACCURACY

PRIORITY ON FILM REMOVING SPEED

FILM REMOVING METHOD, NOZZLE FOR REMOVING FILM, AND FILM REMOVING DEVICE

TECHNICAL FIELD

The present invention relates to a method for removing a film formed on a substrate, and also relates to a nozzle for removing a film and a film removing device that are used for the application.

BACKGROUND ART

Japanese Patent Laid-Open Publication No. 2008-018301 discloses a method in which a coating film is removed in a desired pattern by relatively moving a stage on which a substrate is placed while making a suction port of a suction nozzle contact a wet coating film formed on the substrate and suck the coating film.

CITATION LIST

Patent Literature

Patent Literature 1: Japanese Patent Laid-Open Publication No. 2008-018301 (see FIG. 1 and FIG. 3)

SUMMARY OF INVENTION

Technical Problem

The method disclosed in Japanese Patent Laid-Open Publication No. 2008-018301 may damage a film formed on the substrate and the substrate itself because this method is a contact type method. In addition, this method is not applicable to a film in a dry state. It is to be noted that although disclosing, as a modified preferred embodiment, the wet state is promoted by spraying wet state promoting liquid onto a coating film in a wet state, Japanese Patent Laid-Open Publication No. 2008-018301 does not describe or suggest whether this method is applicable to a film in a dry state. It is also clear that a film in a wet state cannot be formed easily enough to follow a required process speed even if the method is applied to a film in a dry state.

On the one hand, the method disclosed in Japanese Patent Laid-Open Publication No. 2008-018301 causes a problem that when the moving speed of a stage is excessively increased, a coating film cannot be sucked well and may remain without being sucked. On the other hand, when the sucking speed of the coating film is excessively increased, a problem that the coating film may be sucked more than necessary may also be caused. Thus, the efficiency of a process is low.

In order to resolve the above technical problems, it is an object of the present invention to provide a film removing method in which a film in a dry state can efficiently dissolved and removed, a nozzle for removing a film, and a film removing device.

Solution to Problem

A film removing method according to a preferred embodiment of the present invention includes steps of: moving a nozzle head close to a soluble film formed on a substrate; forming a liquid pool of chemical liquid between the nozzle head and the film by continuously and simultaneously discharging and sucking the chemical liquid from the nozzle head; and horizontally moving the substrate in a state in which the nozzle head and a surface of the film are not contacted so as to relatively move the liquid pool of the chemical liquid on the substrate.

Alternatively, a film removing method according to another preferred embodiment of the present invention includes steps of: moving a nozzle head close to a soluble film formed on a substrate; forming a liquid pool of chemical liquid between the nozzle head and the film by continuously and simultaneously discharging and sucking the chemical liquid from the nozzle head; and horizontally moving the nozzle head on the substrate in a state in which the nozzle head and a surface of the film are not contacted so as to move the liquid pool of the chemical liquid on the substrate.

This configuration makes it possible to form a liquid pool of the chemical liquid, by surface tension, between the nozzle head close to the surface of the film and the soluble film and to dissolve a part of the film in contact with the liquid pool. This liquid pool is continuously formed by the continuously discharged chemical liquid and the continuously sucked chemical liquid while being always replaced with new chemical liquid. Then, the chemical liquid that has dissolved the part of the film is sucked, and accordingly, the part of the film is removed. Furthermore, the liquid pool is also moved on the substrate along with the horizontal movement of the substrate or the nozzle head, so that the film can be removed in accordance with a movement track of the substrate or the nozzle head.

Moreover, air may be preferably injected into a chemical liquid discharge passage of the nozzle head, so that a flow velocity of the chemical liquid that flows through the chemical liquid discharge passage of the nozzle head will be accelerated by air, and the chemical liquid will come to be squirted (sprayed) from a discharge port of the chemical liquid discharge passage. This applies a mechanical impact to the film and promotes the dissolution and removal of the film by the liquid pool.

In the case of a film in which the above described film is made of a solution or a dispersion, as chemical liquid that dissolves the film, chemical liquid constituting the solution and the dispersion may be preferably used. It should be noted if the film is water soluble, water can be used as the chemical liquid, which will contribute to reduce process costs.

A nozzle for removing a film according to a preferred embodiment of the present invention may preferably include a nozzle head having a chemical liquid discharge passage and a chemical liquid suction passage that are formed hollow. The nozzle for removing a film may preferably have a configuration in which the nozzle head has a tip end surface, the tip end surface includes a linear groove, and a discharge port of the chemical liquid discharge passage and a suction port of the chemical liquid suction passage are open to the both ends of the linear groove.

A droplet scattering suppression wall may be preferably provided around the nozzle head, which can suppress a splash of the chemical liquid from being scattered in a wide range of the surface of the film due to impact caused when the chemical liquid is discharged from the nozzle head. In this case, it is more effective when air in space surrounded by the droplet scattering suppression wall is sucked.

It is to be noted the nozzle for removing a film according to a preferred embodiment of the present invention, in the above described configuration, may preferably have a configuration in which an air injection passage in which air is injected into the chemical liquid discharge passage is connected to the chemical liquid discharge passage.

In addition, a film removing device according to a preferred embodiment of the present invention may preferably include the above described nozzle for removing a film. The film removing device may preferably include: a stage on which a substrate is placed; a chemical liquid supply portion that supplies chemical liquid to the chemical liquid discharge passage; and a chemical liquid suction portion that sucks the chemical liquid from the chemical liquid suction passage.

It should be noted in a case of the nozzle for removing a film having a configuration in which the air injection passage in which air is injected into the chemical liquid discharge passage is connected to the chemical liquid discharge passage, the film removing device according to a preferred embodiment of the present invention may preferably further include an air supply portion that supplies air into the air injection passage.

Additionally, the film removing device according to a preferred embodiment of the present invention may preferably configure the stage as a stage capable of moving in a horizontal direction or may preferably include a nozzle moving portion that horizontally moves the nozzle for removing a film.

Advantageous Effects of Invention

According to the preferred embodiments of the present invention, a film in a dry state can be efficiently dissolved and removed.

BRIEF DESCRIPTION OF THE DRAWINGS

FIG. 2A is a partially cutaway side view illustrating a nozzle for removing a film, FIG. 2B is a bottom view illustrating the nozzle for removing a film, FIG. 2C is a cross sectional view taken as viewed from an arrow line II-II in FIG. 2A, and FIG. 2D is an enlarged view illustrating a tip portion of a nozzle head in FIG. 2C.

FIG. 7 is a table showing respective film removal characteristics when a flow rate of supplying chemical liquid to the nozzle for removing a film is excessively low, appropriate, or excessively high.

DESCRIPTION OF THE PREFERRED EMBODIMENTS

First Preferred Embodiment

Figure 1:
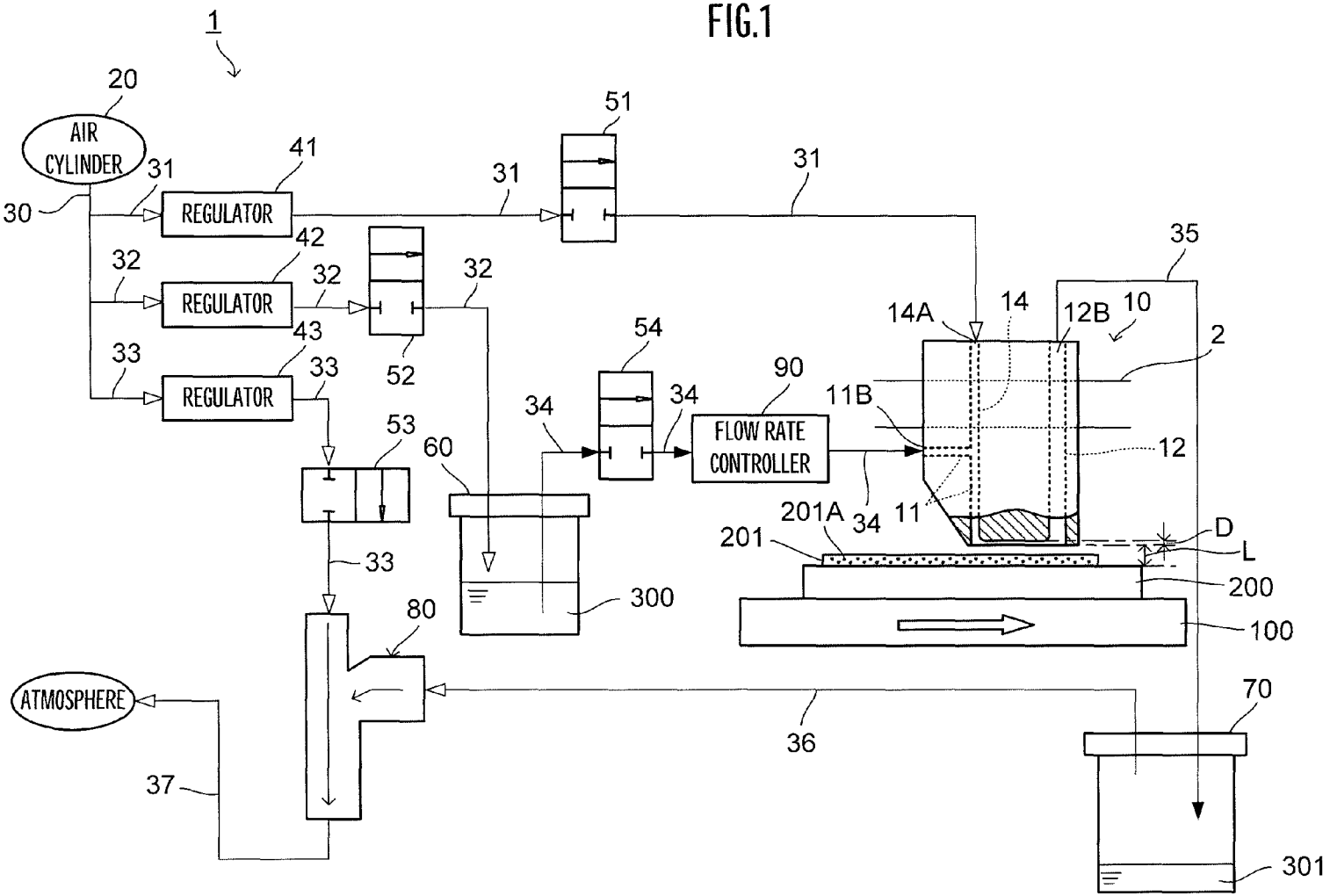
FIG. 1 is a schematic configuration view illustrating a film removing device according to a first preferred embodiment of the present invention.

The schematic configuration of a film removing device according to a first preferred embodiment of the present invention will be described with reference to FIG. 1 and FIG. 2. As illustrated in FIG. 1, the film removing device 1 includes a nozzle 10, an air cylinder 20, pipes 30 to 37, regulators 41 to 43, switch valves 51 to 54, a pressure bottle 60, a waste liquid bottle 70, a vacuum ejector 80, a flow rate controller 90, and a movable stage 100.

The nozzle 10, as illustrated in FIG. 2, includes a nozzle base 10A and a nozzle head 10B. As the material of the nozzle 10, metals having corrosion resistance to chemical liquid, such as stainless steel, are preferably used. The nozzle base 10A has a square pole shape and the nozzle head 10B has a truncated quadrangular pyramidal shape, and both are integrally formed with each other.

As illustrated in FIG. 2A, further provided is a pair of round cross sectional hollow portions (see a vertical hollow portion composed of a downstream side of the chemical liquid discharge passage 112 and the air injection passage 14, and a vertical hole composed of the chemical liquid suction passage 12) that vertically penetrate the nozzle base 10A and the nozzle head 10B in such a manner as to be spaced apart from each other in the longitudinal direction of the nozzle head 10B. The upper ends of the hollow portions are open to the upper surface of the nozzle base 10A (see connection ports 14A and 12B.) The lower ends of the hollow portions are open to the lower surface of the nozzle head 10B (see a discharge port 11A and a suction port 12A.)

At a midway point of the hollow portion on the left side as viewed in FIG. 2A, another hollow portion (see a horizontal hole composed of an upstream side of the chemical liquid discharge passage 111) is connected in a perpendicular direction. The hollow portion (see a connection port 11B) is open to an end face of the nozzle base 10A. The connection ports 11B, 12B, and 14A are connected to pipes, respectively.

The chemical liquid discharge passage 11 includes the upstream side of the chemical liquid discharge passage 111 and the downstream side of the chemical liquid discharge passage 112. As illustrated, a link portion of both discharge passages 111, 112 is connected to the air injection passage 14 so that air can be injected into the chemical liquid flowing through the chemical liquid discharge passage 11.

While a distance (see "P" in FIG. 2A) between the downstream side of the chemical liquid discharge passage 112 and the chemical liquid suction passage 12 is not limited, the distance may be set to about 1 to 15 mm, for example. A diameter of the chemical liquid suction passage 12 is set equal to or larger than the diameter of the chemical liquid discharge passage 11. For example, the diameter of the chemical liquid discharge passage 11 is set to 1 mm and the diameter of the chemical liquid suction passage 12 is set to 2 mm.

As illustrated in FIG. 2B, the tip end surface (the bottom surface) of the nozzle head 10B includes a groove 13 on a straight line along with the longitudinal direction of the nozzle head 10B. According to the preferred embodiment of the present invention, as illustrated in FIG. 2D, a sectional shape of the groove 13 is formed into a semicircular shape. While a width and a depth of the groove 13 are not limited, the width and the depth are set to about 0.1 mm to 1.0 mm, for example. The discharge port 11A of the chemical liquid discharge passage 11 and the suction port 12A of the chemical liquid suction passage 12 are open to both ends of the groove 13, respectively.

As illustrated in FIG. 1, the nozzle 10 is attached to the film removing device 1 by being fixed to a support element 2 placed in the horizontal direction above the movable stage 100 by screwing through a machine screw.

The pipes 30 to 33, 36, and 37 illustrated by outline arrows in FIG. 1 are pipes through which air flows, and the pipes 34 and 35 illustrated by solid arrows are pipes through which chemical liquid flows. It is desirable for these pipes to use a pipe of which material has resistance to pressure.

The air cylinder 20 stores compressed air. The pipe 30 is connected to this air cylinder 20, and, furthermore, three pipes 31 to 33 are connected to this pipe 30 in parallel. Each of the pipes 31 to 33 includes the regulators 41 to 43 and the switch valves 51 to 53. The regulators 41 to 43 regulate the flow rate of the air that flows through the pipes 31 to 33. The switch valves 51 to 53 switch on and off of the circulation of air that flows through the pipes 31 to 33.

The downstream end of the pipe 31 is connected to the air injection passage 14 of the nozzle 10 so as to supply air to the nozzle 10. The downstream end of the pipe 32 is introduced into the pressure bottle 60. The pressure bottle 60 is an airtight container that stores the chemical liquid 300.

The upstream end of the pipe 34 is inserted under the surface of the chemical liquid 300 in the pressure bottle 60. The pipe 34 includes the switch valve 54 and the flow rate controller 90. The switch valve 54 switches on and off of the circulation of chemical liquid that flows through the pipe 34. The flow rate controller 90 controls the flow rate of the chemical liquid which flows through the pipe 34. The downstream end of the pipe 34 is connected to the connection port 11B of the chemical liquid discharge passage 11 of the nozzle 10.

As the chemical liquid 300, liquid that dissolves the film 201 on the substrate 200 is preferably used. In particular, when the film 201 is water soluble, water that is easy to be obtained and handled can be used as liquid that dissolves a film, so that process costs can be reduced.

The upstream end of the pipe 35 is connected to the connection port 12B of the chemical liquid suction passage 12 of the nozzle 10. The downstream end of the pipe 35 is introduced into the waste liquid bottle 70. The waste liquid bottle 70 is an airtight container that stores the chemical liquid 301 which has dissolved the film 201.

The downstream end of the pipe 33 is connected to an air feed port of the vacuum ejector 80. The upstream end of the pipe 36 is inserted into the waste liquid bottle 70. The downstream end of the pipe 36 is connected to an air inlet port of the vacuum ejector 80. The upstream end of the pipe 37 is connected to an air exhaust port of the vacuum ejector 80. The downstream end of the pipe 37 is open to an external exhaust line. The pipes 33, 36, and 37 define a vacuum line.

The movable stage 100 is configured to be capable of horizontally moving in the XY direction. The substrate 200 is placed on the movable stage 100. While a moving speed of the movable stage 100 is not limited, the moving speed is set to 50 mm/s, for example.

The film 201 in a dry state is formed on the substrate 200. The film 201 is a film consisting of substance 201A having a property of dissolving the chemical liquid 300. While a thickness of the film 201 is not limited, the thickness is preferably set to be 1 μm or less. It is to be noted that film removal to be described below can be efficiently performed by previously applying plasma, UV rays, and the like to the film 201 to decrease the film strength.

Subsequently, a film removing method using the film removing device 1 configured as described above will be described with reference to FIG. 1, FIG. 3, and FIG. 4.

To begin with, the nozzle head 10B of the nozzle 10 is moved closer to the soluble film 201. At this time, while a distance (see "L" in FIG. 1) between the tip of the nozzle head 10B and the surface of the substrate 200 is not limited, the distance may be set to about 50 μm, for example. Since a thickness of the film 201 is set to 1 μm or less, such a distance L is suitable to maintain a state in which the nozzle head 10B is non-contact with the film 201 while the distance between the tip of the nozzle head 10B and the surface of the film 201 is made as small as possible. In addition, since the tip of the nozzle head 10B, the film 201, and the substrate 200 are not contacted, the film removing method of the preferred embodiments according to the present invention can be a process in which the smoothness of the surfaces of the film 201 and the substrate 200 is not required severely and a process in which a film remaining after patterning and the substrate itself are not damaged.

Figure 3A:
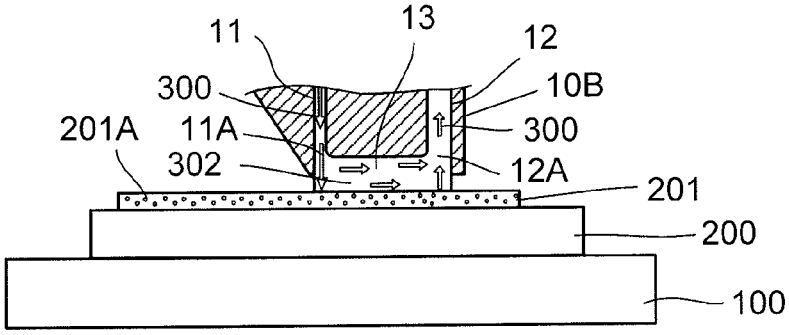
FIG. 3A to FIG. 3C are explanatory views schematically illustrating each step of a film removing method according to preferred embodiments of the present invention.

Then, while the air cylinder 20 is opened, the regulators 41 to 43, the switch valves 51 to 54, and the flow rate controller 90 are properly controlled. Accordingly, air is supplied to the air injection passage 14 of the nozzle 10 through the pipe 31. Air is also supplied to an enclosed space of the pressure bottle 60 through the pipe 32, the chemical liquid 300 is pressed out to the pipe 34, and the chemical liquid 300 is supplied to the chemical liquid discharge passage 11 of the nozzle 10 through the pipe 34. The pressure of the supplied chemical liquid 300 is regulated by the regulator 54 so as to be set to 0.05 MPa, for example. The final fluid volume of the chemical liquid is controlled by the flow rate controller 90. Thus, as illustrated in FIG. 3A, the chemical liquid 300 is discharged from the discharge port 11A of the chemical liquid discharge passage 11 of the nozzle 10 toward a space between the tip end surface of the nozzle head 10B and the substrate 200.

Further, air is press injected into the vacuum ejector 80 through the pipe 33. The air is exhausted and diffused from the air exhaust port of the pipe 37 and discharged to the external exhaust line through the pipe 37. As a result, the air inlet port of the vacuum ejector 80 becomes in a negative pressure state, and the air in the enclosed space in the waste liquid bottle 70 is sucked through the pipe 36. Then, the inside of the waste liquid bottle 70 becomes in the negative pressure state, and the air in the chemical liquid suction passage 12 of the nozzle 10 is sucked through the pipe 35. By the suction of air, as illustrated in FIG. 3A, the chemical liquid 300 discharged to the space between the tip end surface of the nozzle head 10B and the substrate 200 is sucked from the suction port 12A of the chemical liquid suction passage 12.

Figure 4:
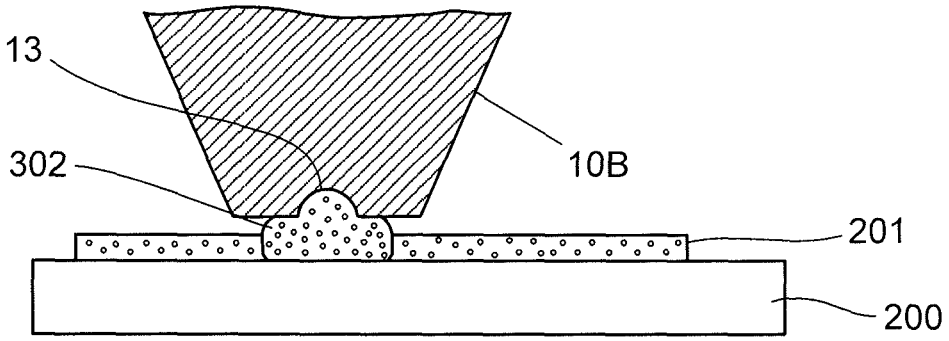
FIG. 4 is a cross sectional view taken as viewed from an arrow line IV-IV in FIG. 3B.

Thus, between the tip end surface of the nozzle head 10B and the film 201 (the substrate 200), the chemical liquid 300 flows from the discharge port 11A of the chemical liquid discharge passage 11 toward the suction port 12A of the chemical liquid suction passage 12 by use of the groove 13 on the straight line of the tip end surface of the nozzle head 10B as a guide, and a liquid pool 302 is formed by surface tension. The groove 13, as illustrated in FIG. 4, suppresses the liquid pool 302 from spreading, so that the chemical liquid is hard to drip to the outside of the nozzle head 10B, thereby contributing to improvement in accuracy of film removal.

As described above, since the diameter of the chemical liquid suction passage 12 is set to become larger than the diameter of the chemical liquid discharge passage 11, the flow rate of the chemical liquid which flows through the chemical liquid suction passage 12 increases relatively. Consequently, the chemical liquid smoothly flows along a U-shaped passage across the chemical liquid discharge passage 11, the groove 13, and the chemical liquid suction passage 12.

Figure 3B:
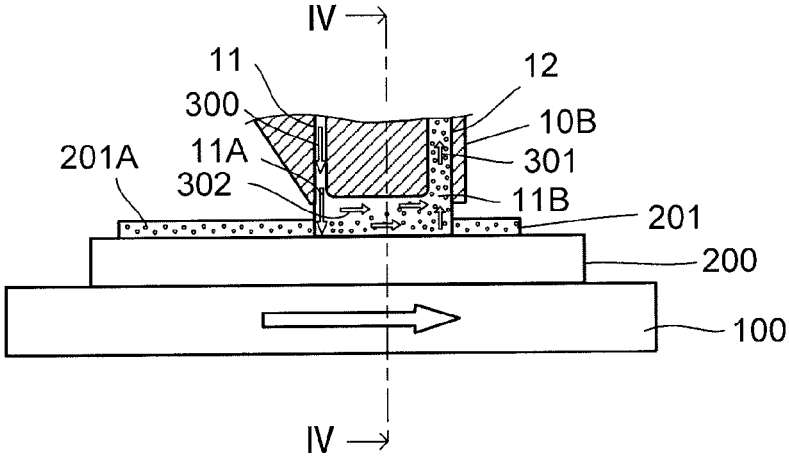

The chemical liquid dissolves the film 201 of which a part is in contact with the liquid pool 302 as illustrated in FIG. 3B. This liquid pool 302 is continuously formed by the continuously discharged chemical liquid 300 and the continuously sucked chemical liquid 301 while being always replaced with new chemical liquid. Then, the chemical liquid 301 that has dissolved the part of the film 201 is sucked, and accordingly, the part of the film 201 is removed. The chemical liquid 301 flows through the chemical liquid suction passage 12, and is discharged to and finally stored in the waste liquid bottle 70 through the pipe 35.

As a result of diligent studies, the inventors of the present invention have found that a state of the liquid pool 302 varies by varying the flow rate of supplying chemical liquid to the nozzle 10 by the flow rate controller 90, and effective film removal requires a range of a proper flow rate, and the quality of the film removal is downgraded when the flow rate is smaller or larger than the range.

FIG. 7 is a table showing a relationship between the flow rate of supplying chemical liquid and the film removal characteristics. As illustrated in FIG. 7, when the flow rate of supplying chemical liquid was excessively low (less than the flow rate R1), the suction was prioritized, and the film removal could not be performed. When the flow rate of supplying chemical liquid was appropriate (not less than the flow rate R1 and less than the flow rate R2), the film removal was effectively performed by pulse impact. When the flow rate of supplying chemical liquid was excessively high (not less than R2), the liquid pool 302 was bloated, and the quality of the film removal was downgraded. It should be noted that the values of R1 and R2 (R1<R2) as threshold values of the flow rate vary according to the specification of the nozzle 10, the viscosity of the chemical liquid, and the like.

Hereinafter, the reason why the film removal characteristics vary in this way will be described with reference to FIGS. 8A to 8C, FIGS. 9A to 9C, and FIGS. 10A to 10C. FIGS. 8A to 8C and FIGS. 9A to 9C are schematic views illustrating how the flow of the chemical liquid which flows between the nozzle head and the substrate changes by the flow rate of supplying chemical liquid. FIGS. 10A to 10C are views illustrating with a shape of a cross section of a film removed region how the film removal characteristics change by the flow rate of supplying chemical liquid.

Figure 8A:
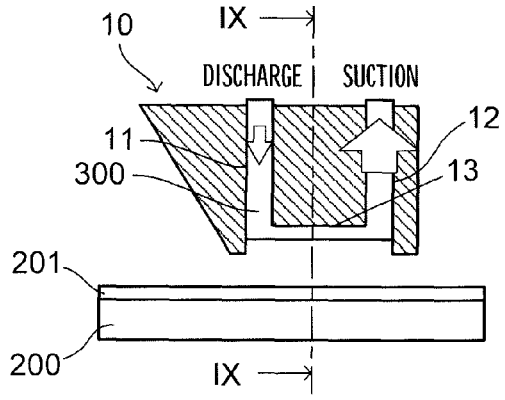
FIG. 8A is a schematic view illustrating a way of a flow of chemical liquid that flows between a nozzle head and a substrate when the flow rate of supplying chemical liquid to a nozzle for removing a film is excessively low.
Figure 9A:
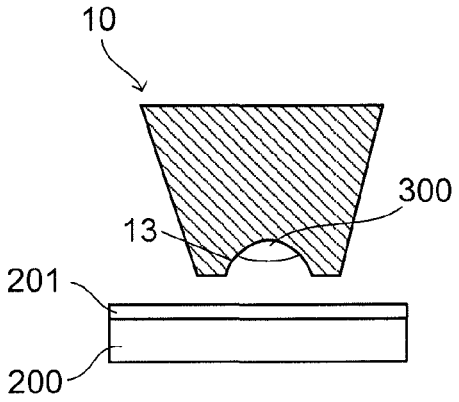
FIG. 9A is a sectional view taken along a line IX-IX in FIG. 8A.
Figure 10A:
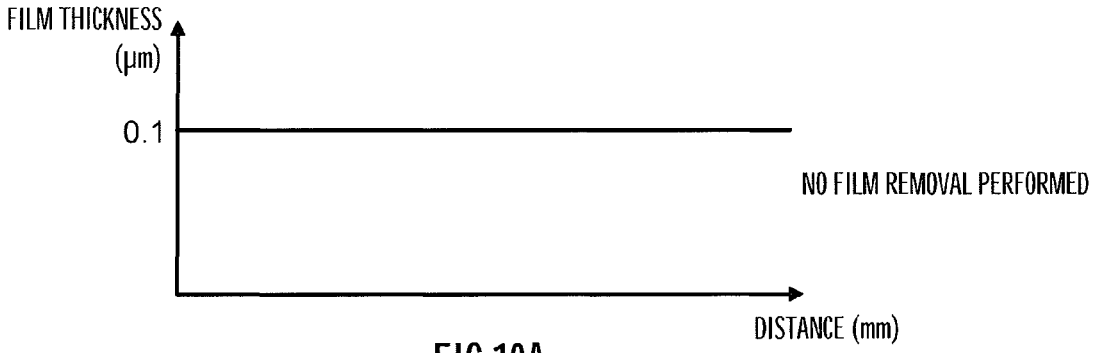
FIG. 10A is a view illustrating a state of a cross section of a film removed region formed when the flow rate of supplying chemical liquid to the nozzle for removing a film is excessively low.
Figure 10B:
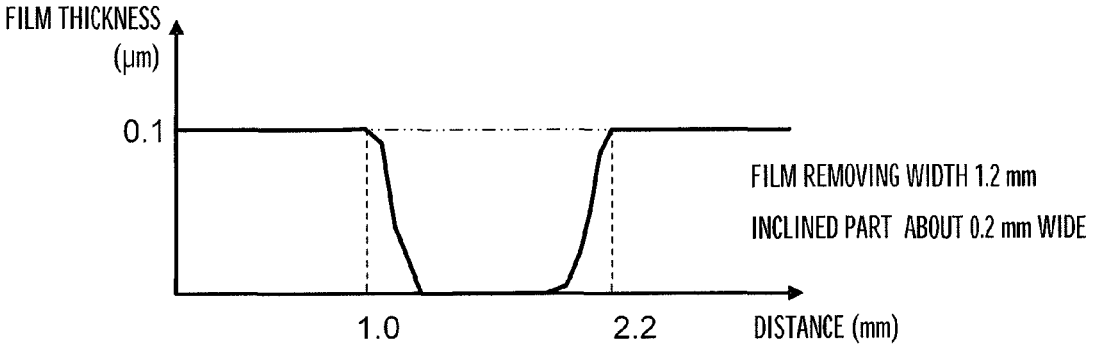
FIG. 10B is a view illustrating a state of a cross section of a film removed region formed when the flow rate of supplying the chemical liquid to the nozzle for removing a film is appropriate.
Figure 10C:
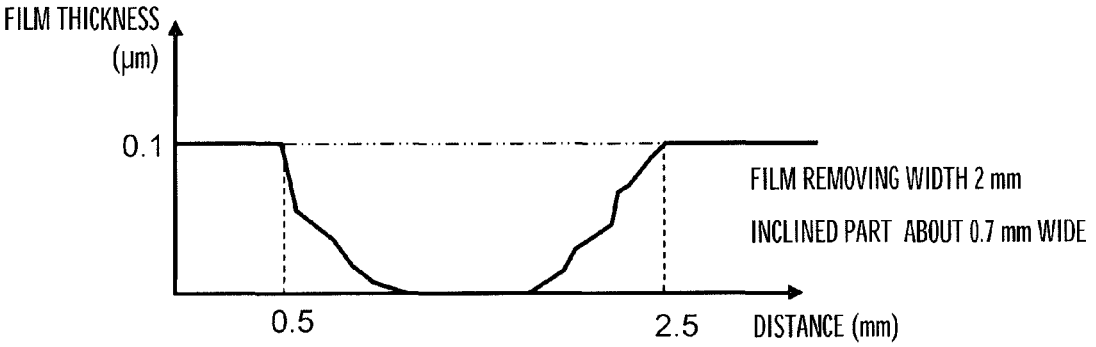
FIG. 10C is a view illustrating a state of a cross section of a film removed region formed when the flow rate of supplying the chemical liquid to the nozzle for removing a film is excessively high.

FIG. 8A and FIG. 9A illustrate a state in which the flow rate of supplying chemical liquid to the nozzle 10 is excessively low, and at this time, as illustrated by the size of the arrows in the views, the sucked amount of the chemical liquid is excessively larger than the discharged amount of the chemical liquid, so that the chemical liquid 300 does not constantly contact the substrate 200 (the film 201). Thus, even if the substrate 200 is horizontally moved, as illustrated in FIG. 10A, the film 201 will not be removed.

Figure 8B:
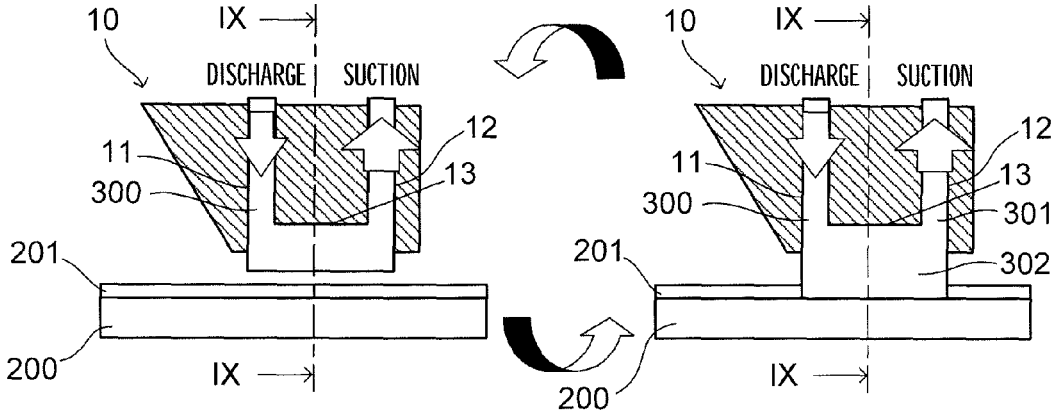
FIG. 8B is a schematic view illustrating a way of the flow of the chemical liquid that flows between the nozzle head and the substrate when the flow rate of supplying the chemical liquid to the nozzle for removing a film is appropriate.
Figure 9B:
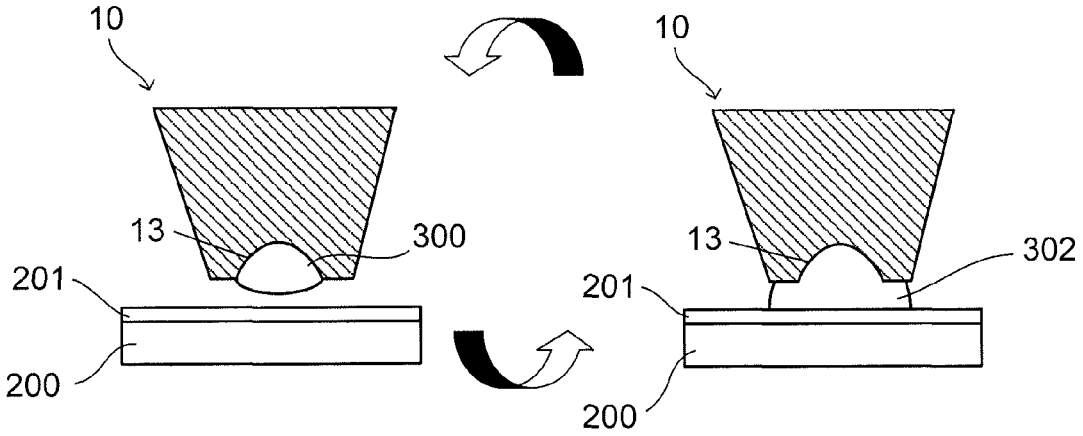
FIG. 9B is a sectional view taken along a line IX-IX in FIG. 8B.

FIG. 8B and FIG. 9B illustrate a state in which the flow rate of supplying chemical liquid to the nozzle 10 is appropriate, and at this time, as illustrated by the size of the arrows in the views, the sucked amount of the chemical liquid is well-balanced with the discharged amount of the chemical liquid, and the pulse impact by the liquid pool 302 is applied to the film 201 by repeatedly switching between a state in which the chemical liquid 300 contacts the substrate 200 (the film 201) and a state in which the chemical liquid 300 does not contact the substrate 200 (the film 201) at high speed. As illustrated in FIG. 10B, the cross section of a film removed region formed in the film 201 by horizontal movement of the substrate 200 with the movable stage 100 has a film removing width of 1.2 mm and a width of an inclined part of both ends of approximately 0.2 mm.

Figure 8C:
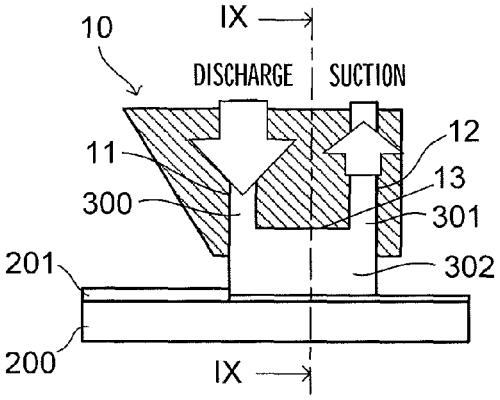
FIG. 8C is a schematic view illustrating a way of the flow of the chemical liquid that flows between the nozzle head and the substrate when the flow rate of supplying the chemical liquid to the nozzle for removing a film is excessively high.
Figure 9C:
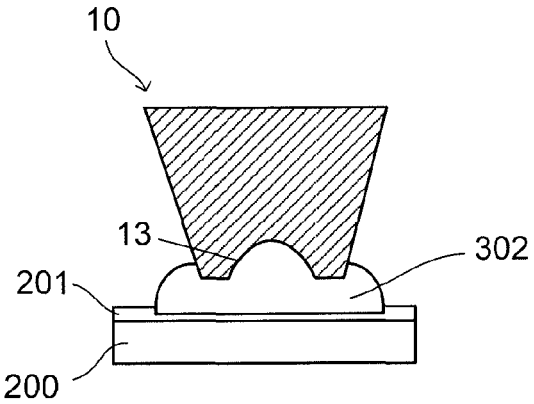
FIG. 9C is a sectional view taken along a line IX-IX in FIG. 8C.

FIG. 8C and FIG. 9C illustrate a state in which the flow rate of supplying chemical liquid to the nozzle 10 is excessively high, and at this time, as illustrated by the size of the arrows in the views, the discharged amount of the chemical liquid is excessively larger than the sucked amount of the chemical liquid, so that the liquid pool 302 is constantly generated on the substrate 200 (the film 201) and the chemical liquid tends to overflow. As illustrated in FIG. 10C, the cross section of a film removed region formed in the film 201 by horizontal movement of the substrate 200 with the movable stage 100 has a film removing width of 2 mm and a width of an inclined part of approximately 0.7 mm. Since the flow rate of supplying chemical liquid is high, the film removing width becomes wider and the edge also becomes broader, which shows that the quality of the film removed region is downgraded.

As described above, when the flow rate of supplying chemical liquid to the nozzle 10 is appropriate, the chemical liquid repeats contacting and non-contacting the substrate 200 (the film 201), so that the impact causes the chemical liquid to splash and scatter widely, resulting in a possibility that the film 201 is dissolved at a place away from a desired film removed region and a defect can be generated.

Figure 11A:
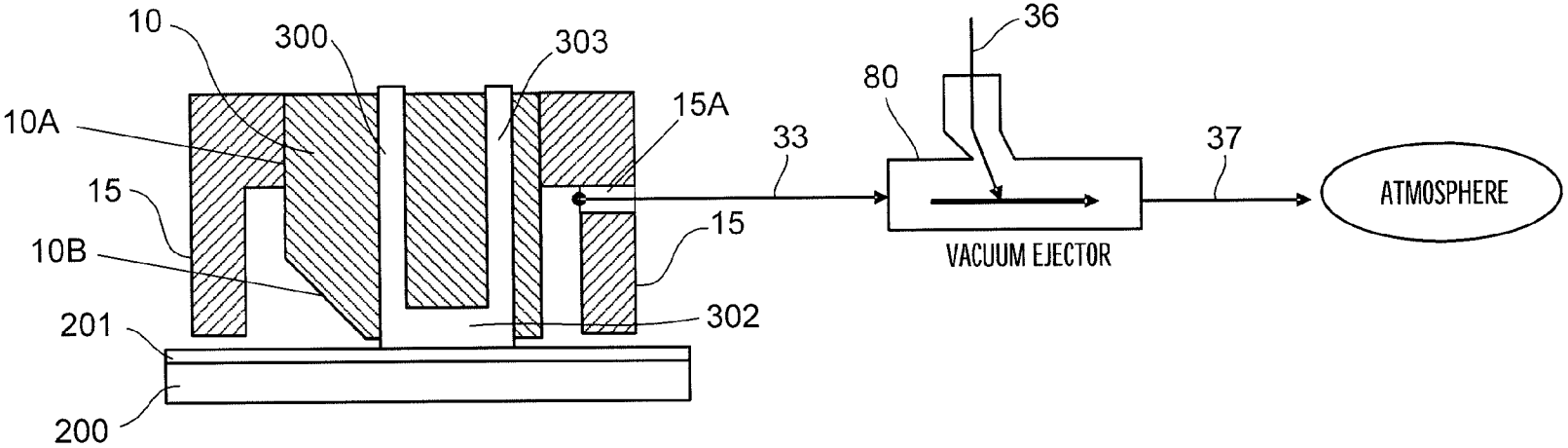
FIG. 11A is a schematic view illustrating a chemical liquid scattering preventive mechanism provided in the nozzle for removing a film.
Figure 11B:
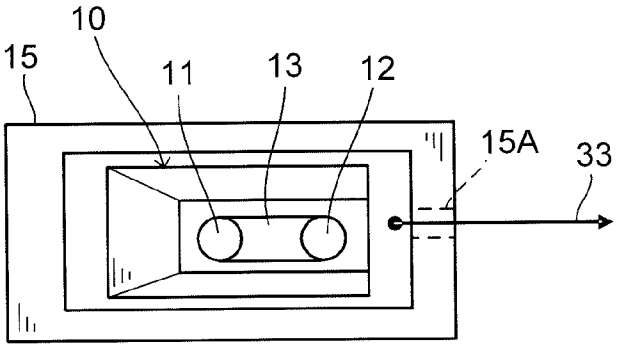
FIG. 11B is a bottom view of the nozzle for removing a film equipped with a droplet scattering suppression wall.

In view of the foregoing, it is necessary to take suppressive measures against scattering of droplets. Specifically, as illustrated in FIGS. 11A and 11B, a droplet scattering suppression wall 15 is provided in the surroundings of the nozzle head 10B and an air exhaust hole 15A provided at one point in the droplet scattering suppression wall 15 is connected to the pipe 33 for exhausting air. The space surrounded by the droplet scattering suppression wall 15 becomes in a negative pressure state by exhausted air. Thus, the droplets of the chemical liquid that are scattered by pulse impact are sucked into the space and can be suppressed from scattering to a place away from the film removed region.

Figure 12:
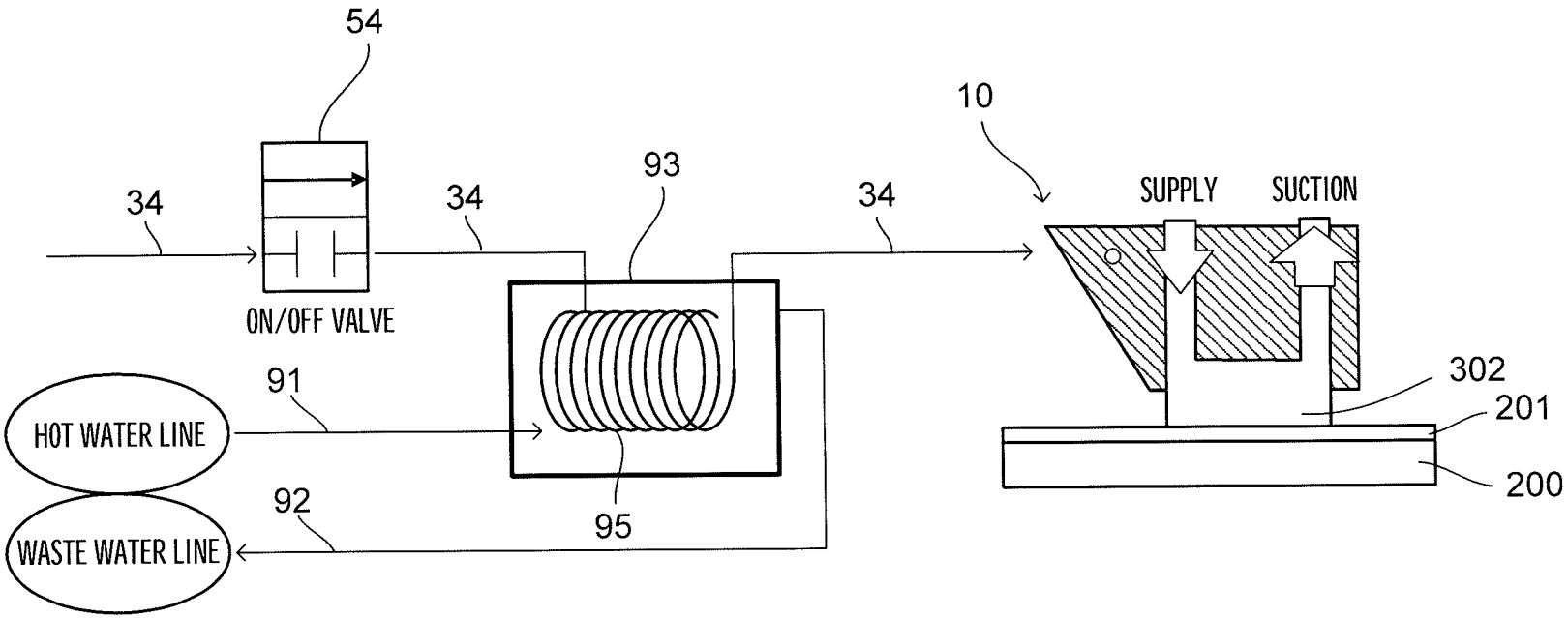
FIG. 12 is a schematic view illustrating a chemical liquid heating mechanism.

In order to improve the film removing efficiency, the chemical liquid supplied to the nozzle 10 may preferably be heated. Specifically, as illustrated in FIG. 12, it is possible to employ a configuration in which a hot water line 91 and a waste water line 92 are connected to a heat exchanger 93 equipped with a spiral tube 95 made of Teflon (registered trademark) and the spiral tube 95 is connected to a midway point of the pipe 34 for supplying chemical liquid. The temperature of hot water that flows through the hot water line 91 is set to 80° C. as an example. According to this configuration, the chemical liquid that flows through the pipe 34 and is supplied to the nozzle 10 is heated to, for example, 40° C.

Figure 13:
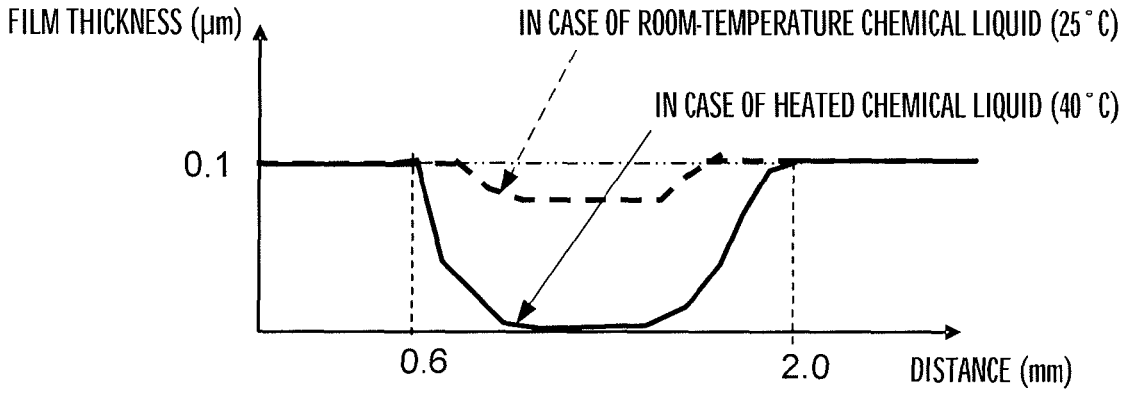
FIG. 13 is a view illustrating states of a cross section of a film removed region formed when chemical liquid at a room temperature is supplied to the nozzle for removing a film and when heated chemical liquid is supplied to the nozzle for removing a film.

When the film 201 is removed by horizontally moving the substrate 200 with the movable stage 100, as illustrated in FIG. 13, and the heated chemical liquid and the room-temperature chemical liquid were compared with the same horizontal movement speed (80 mm/s in this example) and the same horizontal movement frequency (once in this example), the film removing efficiency was improved remarkably in the case of using the heated chemical liquid compared to using the room-temperature chemical liquid. It is considered because dissolution of binder resin that forms the film 201 was accelerated when heat was applied to the chemical liquid, so that the film removal can be performed more effectively.

In addition, air is injected into the chemical liquid 300 that flows through the chemical liquid discharge passage 11 via the air injection passage 14, so that the flow velocity of the chemical liquid 300 that flows through the chemical liquid discharge passage 11 will be accelerated and the chemical liquid 300 will come to be squirted (sprayed) from the discharge port 11A of the chemical liquid discharge passage 11. This applies a mechanical impact to the film 201 by liquid pressure of the chemical liquid and promotes the dissolution and removal of the film 201 by the liquid pool 302.

Figure 3C:
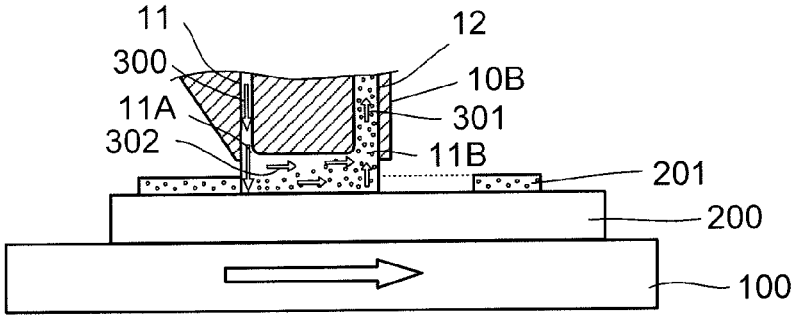

Further, as illustrated in FIGS. 3B and 3C, while the movable stage 100 horizontally moves in the XY direction, the liquid pool 302 also moves relatively to the substrate 200 and the film 201 can be removed in accordance with a movement track of the movable stage 100. The film 201 could be linearly removed with a width of 2 mm by applying the method of the present invention to an approximate 100 nm thick film 201 formed on the substrate 200.

According to the preferred embodiments of the present invention, the film 201 in a dry state can be efficiently dissolved and removed. Moreover, the control of a flow rate and liquid pressure of the chemical liquid, and a moving speed of the stage makes it possible to remove a film that is hard to dissolve. An additional tool such as a heater to heat chemical liquid is also effective.

Second Preferred Embodiment

Figure 5:
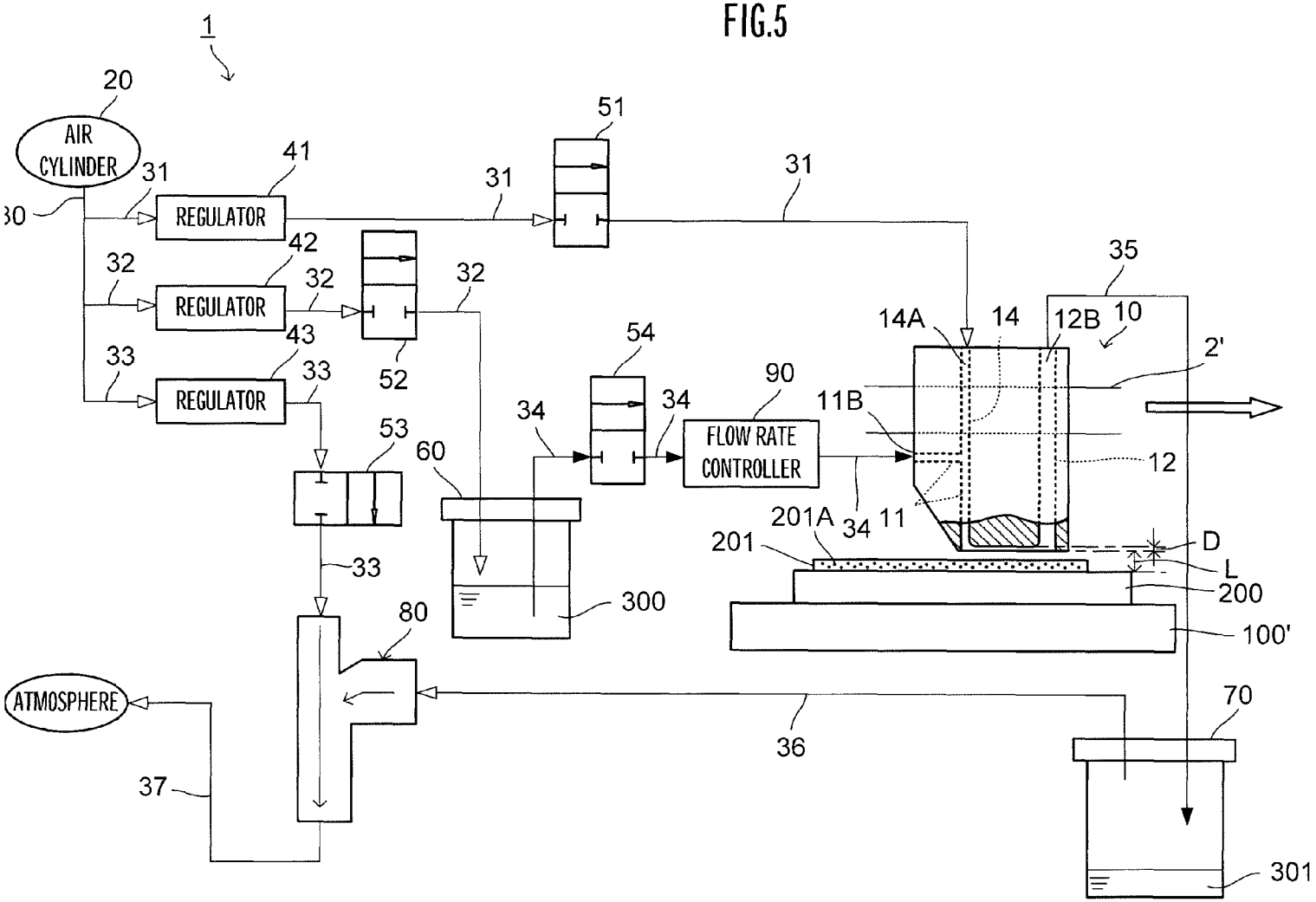
FIG. 5 is a schematic configuration view illustrating a film removing device according to a second preferred embodiment of the present invention.

FIG. 5 is a schematic configuration view illustrating a film removing device according to a second preferred embodiment of the present invention. While, according to the first preferred embodiment of the present invention, the nozzle 10 is fixed, and the liquid pool 302 of the chemical liquid is relatively moved on the substrate 200 by horizontally moving the movable stage 100, according to the second preferred embodiment of the present invention, as illustrated in FIG. 5, the nozzle 10 may be supported against a movable support element 2', and the liquid pool 302 of the chemical liquid may be moved on the substrate 200 by horizontally moving the nozzle head 10B on the substrate 200 mounted on a fixed stage 100'. It is to be noted that the movable support element 2' is configured to be movable not only in a horizontal direction but in a vertical direction so as to make the nozzle 10 spaced away from the substrate 200.

As for a single horizontal movement of the nozzle 10, although the film removing width of a film removed region is almost the same even if the horizontal movement speed is fast or slow, the inclined parts on both ends of the film removed region will become gentle and the edge will become loose when the horizontal movement speed is fast while the inclined parts on both ends of the film removed region will become steep and the edge will become sharp when the horizontal movement speed is slow.

In this preferred embodiment of the present invention, by having employed a nozzle horizontal movement mechanism with a higher mobility compared to a substrate horizontal movement mechanism, it becomes possible to change an operation method of the film removing device 1 in accordance with purposes of removing a film in the use of differences in film removal characteristics by the above described horizontal movement speed.

Figure 14A:
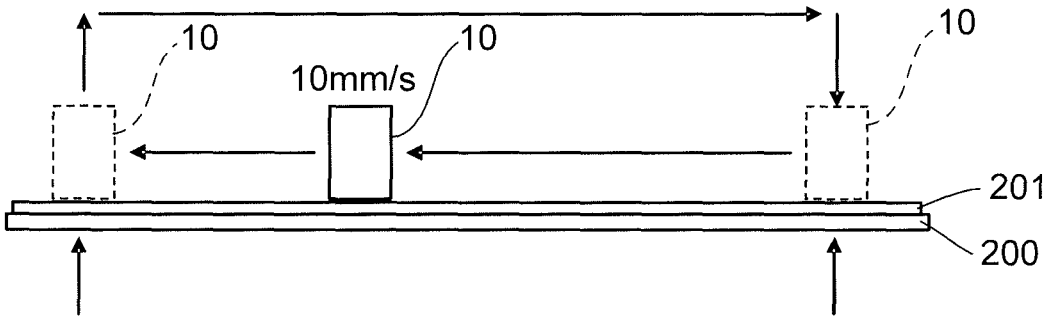
FIG. 14A and FIG. 14B are schematic views illustrating an operation method for each object of the film removing device.

For example, in a certain operation method, as illustrated in FIG. 14A, chemical liquid is supplied to/sucked from the nozzle 10 while the nozzle 10 is horizontally moved in a left direction at a slow horizontal movement speed (10 mm/s in this example), then, the chemical liquid stops being supplied/sucked and the nozzle 10 is separated once from the substrate 200 at a goal point, the nozzle 10 is moved in a right direction and returns to a start point, and the chemical liquid is again supplied to/sucked from the nozzle 10 while the nozzle 10 is horizontally moved in the left direction.

Figure 15:
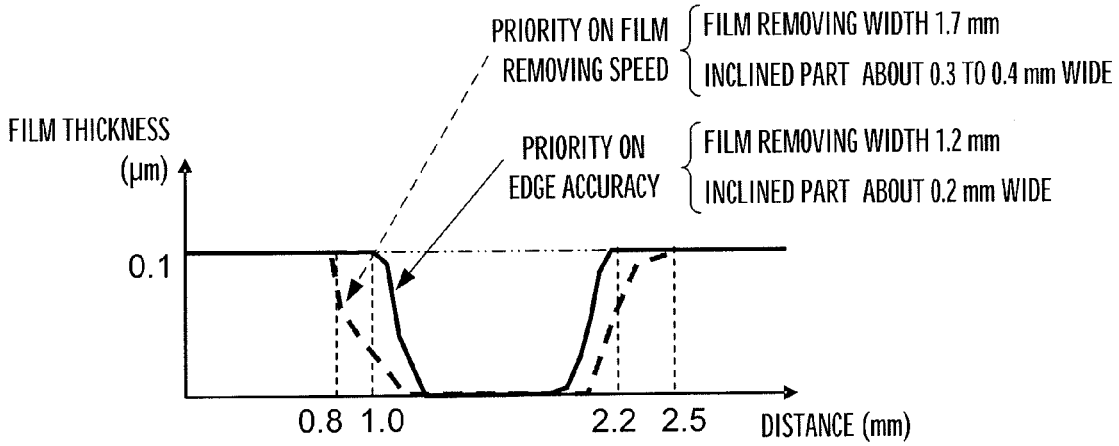
FIG. 15 is a view illustrating a cross section of a film removed region formed according to an operation method of the film removing device.

According to this operation method, the cross section of the film removed region formed in the film 201, as illustrated as a solid line in FIG. 15, had a film removing width of 1.2 mm and a width of the inclined part was approximately 0.2 mm. Therefore, this operation method is suitable for a purpose (giving priority to edge accuracy) requiring edge accuracy on both ends of the film removed region although cycle time becomes slow.

Figure 14B:
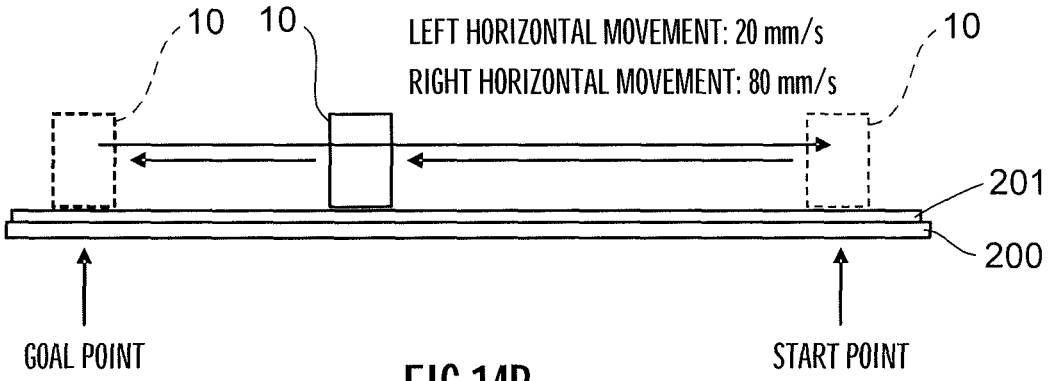

In another operation method, as illustrated in FIG. 14B, while chemical liquid is supplied to/sucked from the nozzle 10, the nozzle 10 is reciprocated to the right and left to horizontally move on the film 201. The horizontal movement speed may differ between left movement (forward movement) and right movement (backward movement). In this example, the horizontal movement speed of the left movement is 20 mm/s and the horizontal movement speed of the right movement is 80 mm/s. The reason why the left movement and the right movement have such differences in horizontal movement speed is because process steps for removing a film, such as a process step in which the film removed region of the film 201 is previously moisturized with chemical liquid during the left horizontal movement and in which the moisturized film is removed at once during the right horizontal movement, are clearly separated during between the left horizontal movement and the right horizontal movement, which enhances repeatability of removing a film.

According to this operation method, the cross section of the film removed region formed in the film 201, as illustrated as a broken line in FIG. 15, had a film removing width of 1.7 mm and a width of the inclined part was 0.3 mm to 0.4 mm. Thus, this operation method is suitable for a purpose (giving priority to film removing speed) requiring only electric insulation ensured between two regions of the film 201 divided in the film removed region although the edge accuracy of the both ends of the film removed region is decreased. According to this operation method, the cycle time can be shortened. Compared with the previous operation method, the film removing width became wider because the film 201 was previously moisturized and then removed.

In any operation method, the number of reciprocating movements of the nozzle 10 is not limited to one and may preferably be increased properly in accordance with characteristics of the film 201.

Third Preferred Embodiment

Figure 6:
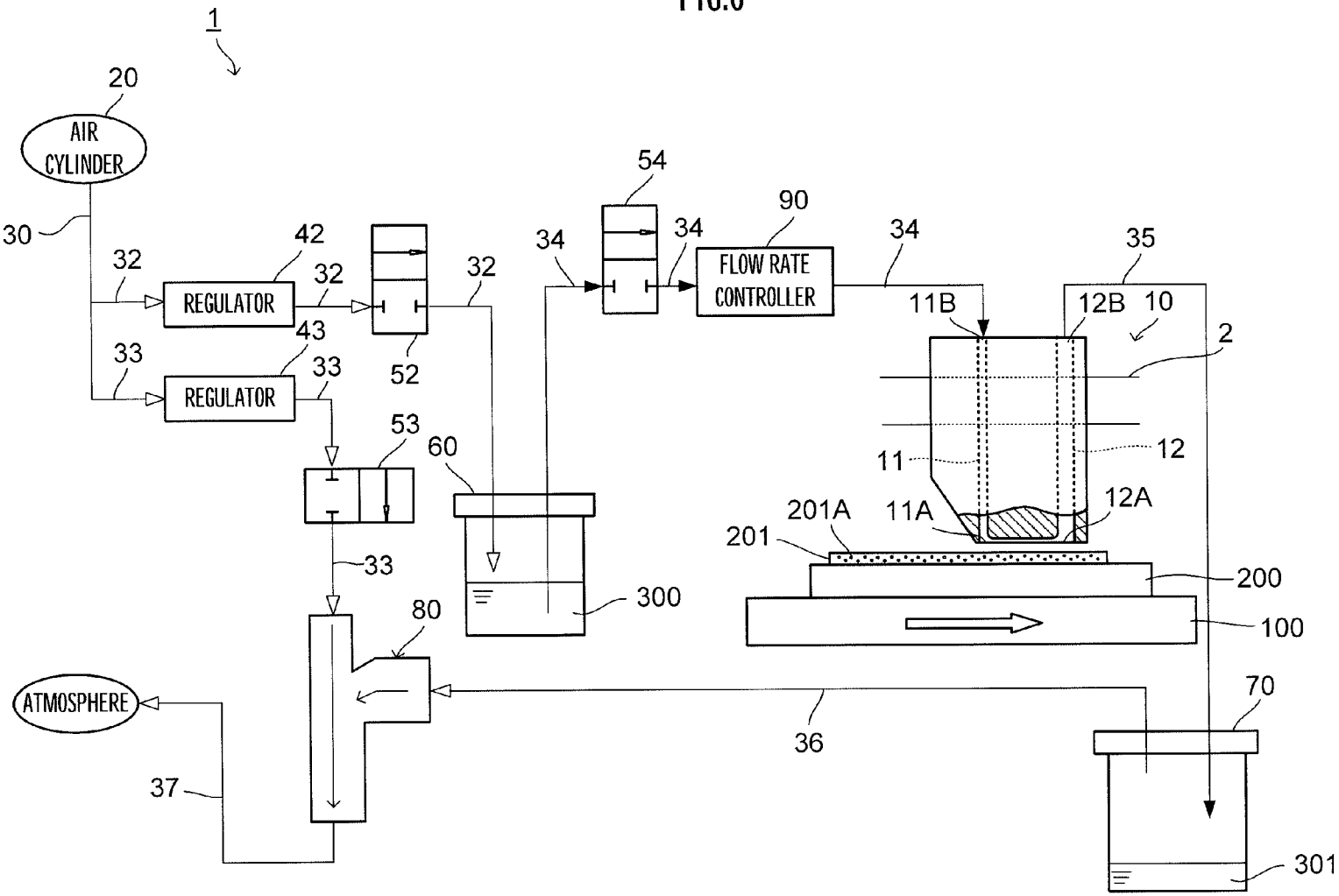
FIG. 6 is a schematic configuration view illustrating a film removing device according to a third preferred embodiment of the present invention.

FIG. 6 is a schematic configuration view illustrating a film removing device according to a third preferred embodiment of the present invention. According to the third preferred embodiment of the present invention, the structure of the nozzle 10 is simplified and the configuration in which air is injected into chemical liquid which flows through the chemical liquid discharge passage 11 is omitted. That is, as illustrated in FIG. 6, the nozzle 10 has no air injection passage and includes only the chemical liquid discharge passage 11 and the chemical liquid suction passage 12 that are arranged in such a manner as to be spaced apart from each other in the longitudinal direction of the nozzle head 10B and as to vertically penetrate the nozzle base 10A and the nozzle head 10B.

According to this preferred embodiment, although chemical liquid cannot be squirted from the discharge port 11A since air is not injected to the nozzle 10, it is possible to efficiently dissolve and remove a film when the flow rate of supplying chemical liquid is appropriately controlled by the flow rate controller 90 as described above and the liquid pool 302 formed between the tip end surface of the nozzle head 10B and the substrate 200 applies pulse impact to the film 201.

The above described embodiments are to be considered in all respects as illustrative and not restrictive. The scope of the present invention is defined not by above described embodiments but by the claims. Further, the scope of the present invention is intended to include all modifications that come within the meaning and scope of the claims and any equivalents thereof.

INDUSTRIAL APPLICABILITY

The present invention is applicable to the field of organic EL elements and organic semiconductors, that is, applications such as patterning of a film formed on a substrate and removal of a part of a film on a border when multiple substrates are obtained from a film uniformly formed on a single substrate.

REFERENCE SIGNS LIST

1—film removing device
2—support element
2'—movable support element (nozzle moving portion)
10—nozzle for removing a film
11—chemical liquid discharge passage
12—chemical liquid suction passage
13—groove
14—air injection passage
20—air cylinder
30 to 37—pipe
41 to 43—regulator
51 to 54—switch valve
60—pressure bottle
70—waste liquid bottle
80—vacuum ejector
90—flow rate controller
100—movable stage
100'—stage
20, 30, 32, 42, 52, 54, 60, 34, 54, 90—chemical liquid supply portion
20, 33, 35, 37, 43, 53, 70, 80—chemical liquid suction portion
20, 30, 31, 41, 51—air supply portion
300, 301—chemical liquid
302—liquid pool

What is claimed is:

1. A film removing method comprising steps of:
moving a nozzle head close to a soluble film formed on a substrate;
forming a liquid pool of chemical liquid between the nozzle head and the film by continuously and simultaneously discharging and sucking the chemical liquid from the nozzle head; and
removing the film by horizontally moving the substrate in a state in which the nozzle head and a surface of the film are not contacted so as to relatively move the liquid pool of the chemical liquid on the substrate,
wherein the step of forming the liquid pool controls an amount of the chemical liquid which is supplied to the nozzle head in such a manner that the amount is within a predetermined range so that the liquid pool intermittently contacts the surface of the film.

2. The film removing method according to claim 1, further comprising a step of injecting air into a chemical liquid discharge passage of the nozzle head.

3. The film removing method according to claim 1, wherein the chemical liquid used to be discharged and sucked is chemical liquid that dissolves the film.

4. The film removing method according to claim 1, further comprising a step of sucking air from a space which is connected to the nozzle head.

5. A film removing device, comprising:
a nozzle for removing a film, the nozzle having a nozzle head including:
a chemical liquid discharge passage that is formed hollow and provided with a discharge port;
a chemical liquid suction passage that is formed hollow and provided with a suction port; and
a tip end surface including a linear groove to which the discharge port and the suction port are open;
a stage on which a substrate is placed;
a chemical liquid supply portion which supplies the chemical liquid to the chemical liquid discharge passage; and
a chemical liquid suction portion which sucks the chemical liquid from the chemical liquid suction passage,
wherein the chemical liquid supply portion including a flow rate controller for controlling an amount of the chemical liquid in such a manner that the amount is within a predetermined range so that a liquid pool of the chemical liquid intermittently contacts a surface of the film, the liquid pool being formed between the nozzle head and the surface of the film on the substrate.

6. The film removing device according to claim 5, further comprising a droplet scattering suppression wall provided around the nozzle head.

7. The film removing device according to claim 6, wherein the droplet scattering suppression wall includes an exhaust hole for sucking air in space surrounded by the droplet scattering suppression wall.

8. The film removing device according to claim 7, wherein the stage is a movable stage that can move in a horizontal direction.

9. The film removing device according to claim 7, further comprising a nozzle moving portion that horizontally moves the nozzle for removing a film.

10. The film removing device according to claim 6, further comprising an air supply portion that supplies air into the air injection passage.

11. The film removing device according to claim 6, wherein the stage is a movable stage that can move in a horizontal direction.

12. The film removing device according to claim 6, further comprising a nozzle moving portion that horizontally moves the nozzle for removing a film.

13. The film removing device according to claim 5, further comprising an air injection passage which is connected to the chemical liquid discharge passage and into which air is injected.

14. The film removing device according to claim 5, wherein the chemical liquid supply portion further comprises a heating device that heats the chemical liquid.

15. The film removing device according to claim 5, further comprising an air suction portion that sucks air from the suction port.

16. The film removing device according to claim 5, wherein the stage is a movable stage that can move in a horizontal direction.

17. The film removing device according to claim 5, further comprising a nozzle moving portion that horizontally moves the nozzle for removing a film.

18. A film removing method comprising steps of:

moving a nozzle head close to a soluble film formed on a substrate;

forming a liquid pool of chemical liquid between the nozzle head and the film by continuously and simultaneously discharging and sucking the chemical liquid from the nozzle head; and removing the film by horizontally moving the nozzle head on the substrate in a state in which the nozzle head and a surface of the film are not contacted so as to move the liquid pool of the chemical liquid on the substrate, wherein the step of forming the liquid pool controls an amount of the chemical liquid which is supplied to the nozzle head in such a manner that the amount is within a predetermined range so that the liquid pool intermittently contacts the surface of the film.

19. The film removing method according to claim 18, further comprising a step of sucking air from a space which is connected to the nozzle head.

* * * * *